US005971803A

United States Patent [19]

McHugh et al.

[11] Patent Number: 5,971,803

[45] Date of Patent: Oct. 26, 1999

[54] ELECTRICAL CONNECTOR WITH BOARD LOCKING MEANS

[75] Inventors: Bob McHugh, Evergreen, Colo.; Wen-Chun Pei, Taipei, Taiwan

[73] Assignee: Hon Hai Precision Ind. Co., Ltd., Taipei Hsien, Taiwan

[21] Appl. No.: 08/997,294

[22] Filed: Dec. 23, 1997

[30] Foreign Application Priority Data

Dec. 21, 1996 [TW] Taiwan ..... 85220105

[51] Int. Cl.[6] ..... H01R 13/73

[52] U.S. Cl. ..... 439/567

[58] Field of Search ..... 439/567, 571–573

[56] References Cited

U.S. PATENT DOCUMENTS 4,681,389 7/1987 Nakazawa et al. ..... 439/567

5,393,247 2/1995 DiOrazio et al. ..... 439/567

5,632,649 5/1997 Spangler ..... 439/567

*Primary Examiner*—Gary F. Paumen

[57] ABSTRACT

An electrical connector for use with a circuit board mainly comprises an insulative housing having a bottom wall which integrally defines therein a receiving portion consisting of a first cavity and a second cavity. A board locking means received within the receiving portion of the housing, includes a base which is integrally formed with a plurality of first attachment portions for retaining the base in the second cavity in a basic status. A pair of retention portions extend downward from the base for elastically latching with the circuit board. A pair of spaced extensive arms each extending downward from the base, integrally form thereon a second attachment portion for retention within the first cavity thereby orienting and retaining the board locking means in the receiving portion of the housing in an enhancement status. A second space further separates the extensive arms from the retention portions thereby reducing a mutual effect in the spatial relationship therebetween.

8 Claims, 5 Drawing Sheets

ELECTRICAL CONNECTOR WITH BOARD LOCKING MEANS

BACKGROUND OF THE INVENTION

1. Field of the Invention

The present invention relates to an electrical connector mounted on a circuit board, and particularly to an electrical connector with a board locking means for sufficient retention in an insulative housing of the electrical connector.

2. The Prior Art

Conventional electrical connector for use with a computer system is equipped with a number of board locking means to mount the electrical connector onto a circuit board in the computer system. Generally, connector manufacturers pay more attention to the structural design of a retention portion of the board locking means which is used to sufficiently latch with a corresponding hole defined in the circuit board. However, to the design of an attachment portion of the board locking means used for retaining the board locking means within an associated cavity defined in an insulative housing of the electrical connector is usually neglected. Consequently, it is usually happened that when the board locking means is improperly retained or inserted within the circuit board, or when the board locking means is inaccurately oriented in the cavity of the housing, a retention effect between the board locking means and the insulative housing may be reduced. Additionally, if the retention portion and the attachment portion both are substantially formed in a close spatial relationship, the attachment portions retained in a large area within the housing may relatively reduce the elasticity of the retention portion. The apparent example would be a pair of spring claws each formed with a plurality of barbs along opposite lateral edges thereof. Such conventional electrical connectors with board locking means are disclosed in Taiwan Application Nos. 80,207,178, 80,202,099, 80,213,095, 81,205,296, 81,201,057, 81,213,628, 81,212,824, 81,211,189, 82,204,413, 83,207,736, 82,107,923 and 83,106,349.

Accordingly, to resolve the above disadvantages, an object of the present invention is to provide a board locking means including a plurality of retention portions for latching with the circuit board, and a plurality of attachment portions for retention in an insulative housing wherein the mutual effect between the retention portions and the attachment portions through action of an external active force is sufficiently reduced.

Another object of the present invention is to provide a board locking means including a plurality of extensive arms for accurately orienting the inserted board locking means in the insulative housing, and for enhancing the retention effect between the insulative housing and the board locking means.

SUMMARY OF THE INVENTION

According to an aspect of the present invention, an electrical connector for use with a circuit board mainly comprises an insulative housing and a plurality of contacts. The insulative housing includes a bottom wall which integrally defines therein a receiving portion consisting of a first cavity and a second cavity. A board locking means received within the receiving portion of the housing, includes a base which is integrally formed with a plurality of first attachment portions for retaining the base in the second cavity in a basic status, and with a pair of retention portions separated from each other by a first space for elastically latching with a corresponding through hole defined in the circuit board. A pair of spaced and opposed extensive arms respectively extend downward from opposite sides of the base and integrally forms thereon a second attachment portion capable of being retained within the first cavity thereby orienting and retaining the board locking means within the receiving portion of the housing in an enhancement status. A second space further separates the extensive arms from the retention portions thereby reducing the mutual effect of a spatial relationship therebetween.

DETAILED DESCRIPTION OF THE PREFERRED EMBODIMENT

Figure 3:
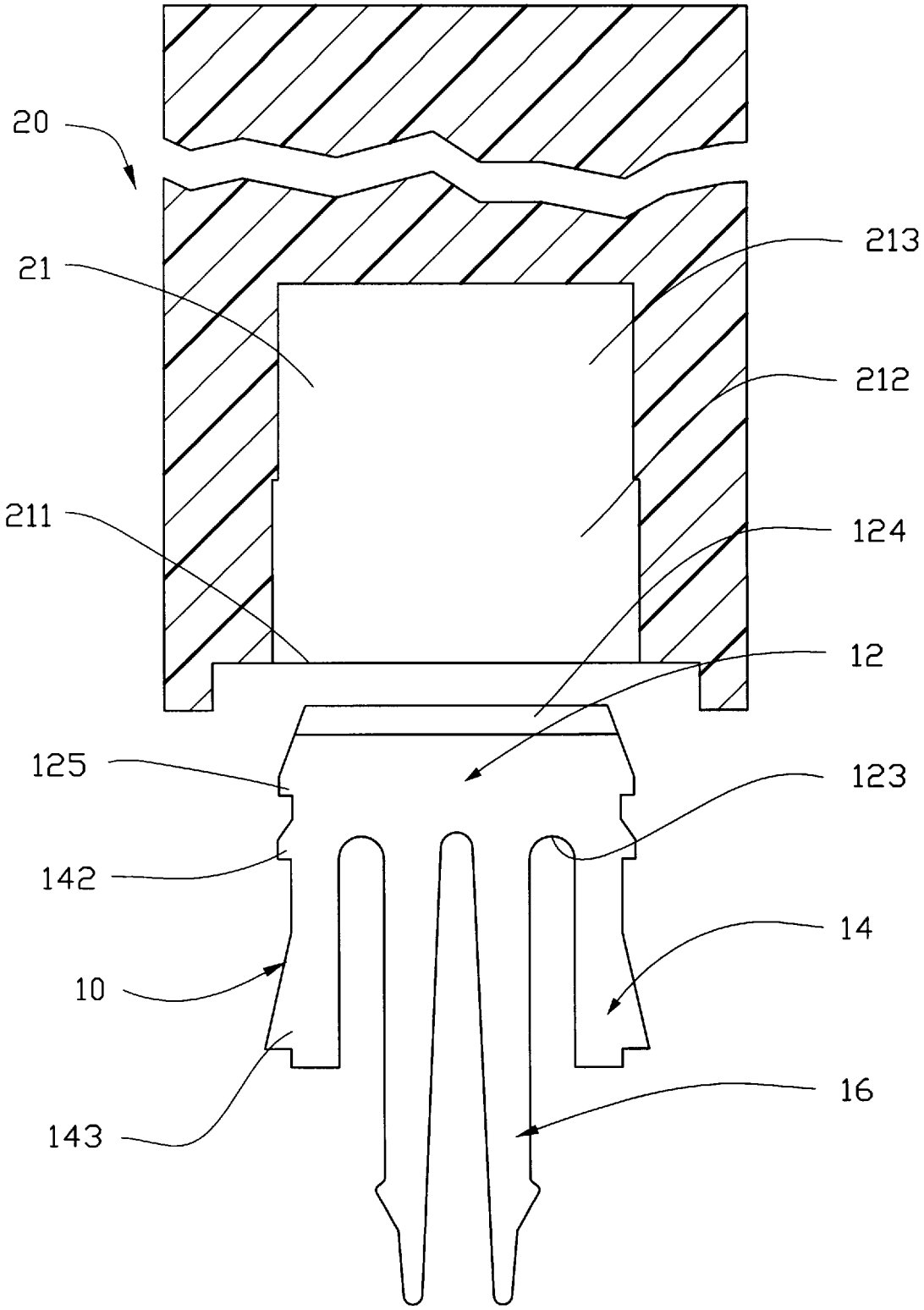
FIGS. 3–5 are cross-sectional views of the electrical connector and the board locking means showing a successive assembly process thereof.
Figure 4:
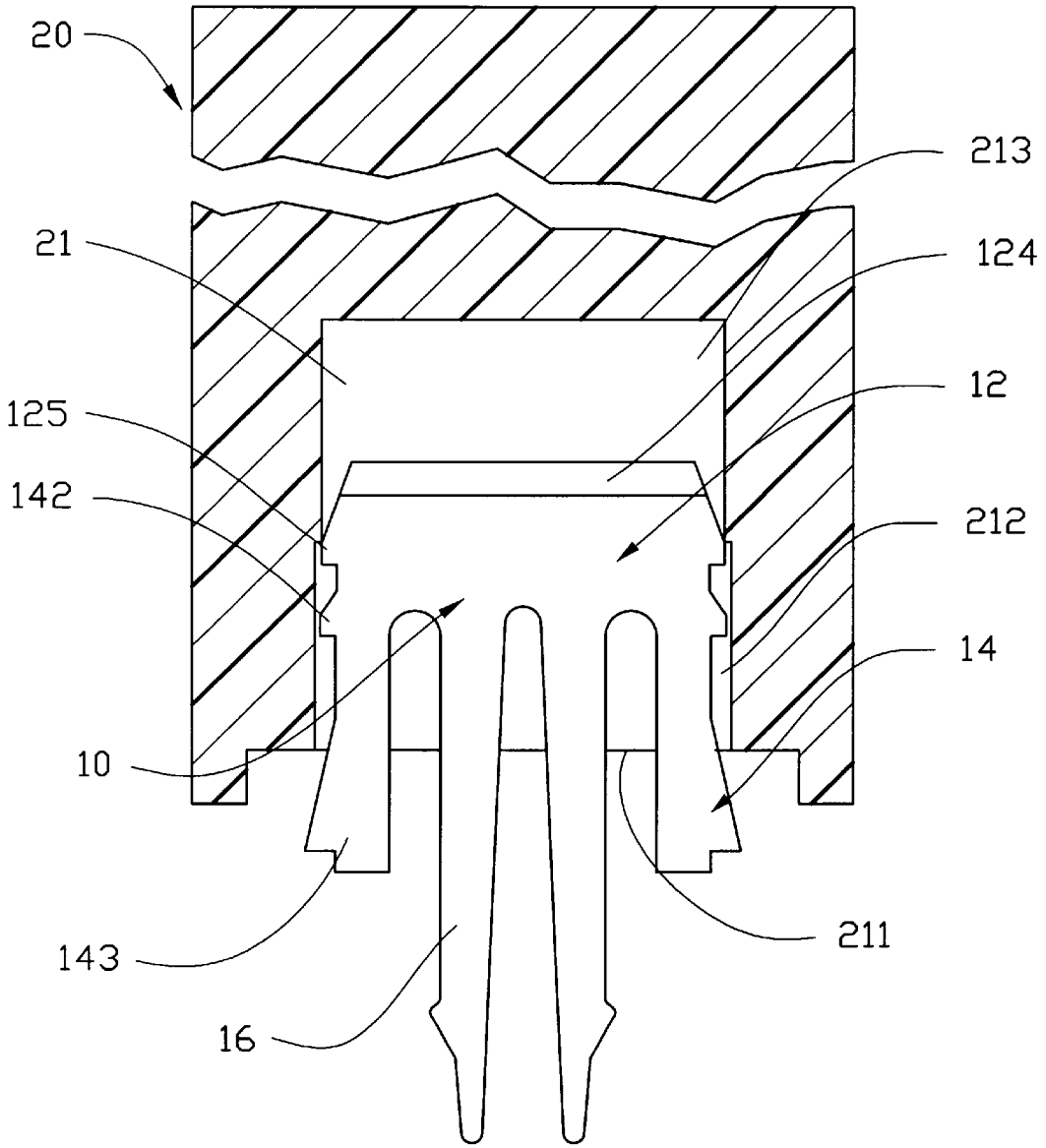
Figure 5:
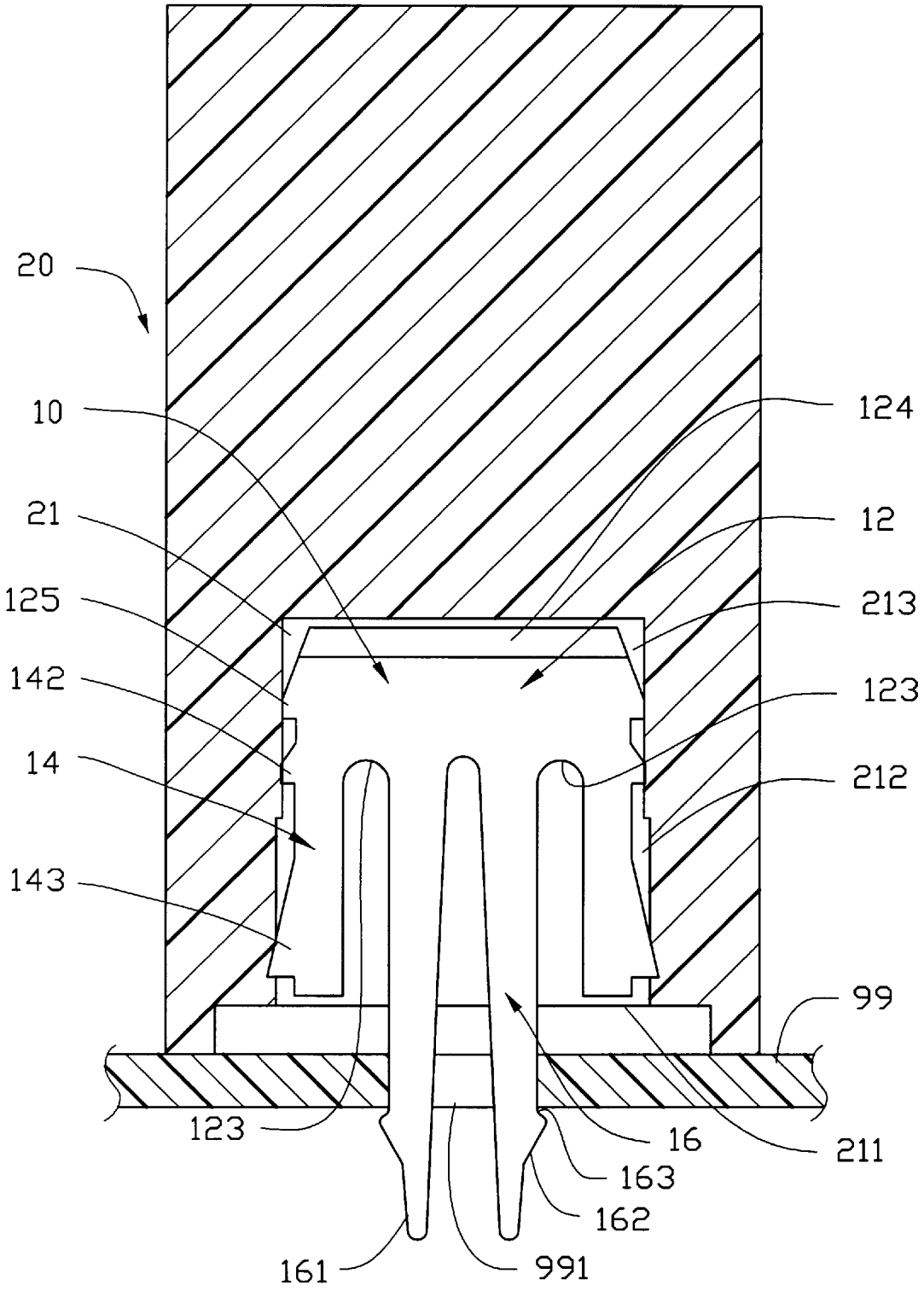

References will now be made in detail with regard to the preferred embodiment of the present invention. An electrical connector (5) for mounting on a circuit board (not shown) is shown in FIGS. 3–5, and includes an insulative housing (20) having a bottom surface (211), which defines a receiving portion (21) therein, facing a top surface (not shown) of the circuit board. The receiving portion (21) consists of a first cavity (212) extending inside the housing (20) from the bottom wall (211), and a second cavity (213) further extending from the first cavity (212) wherein the width of the second cavity (213) is less than that of the first cavity (212). A plurality of contacts (not shown) extends beyond the bottom wall (211) of the housing (20) for being soldered with a plurality of apertures (not shown) in the circuit board.

Figure 1:
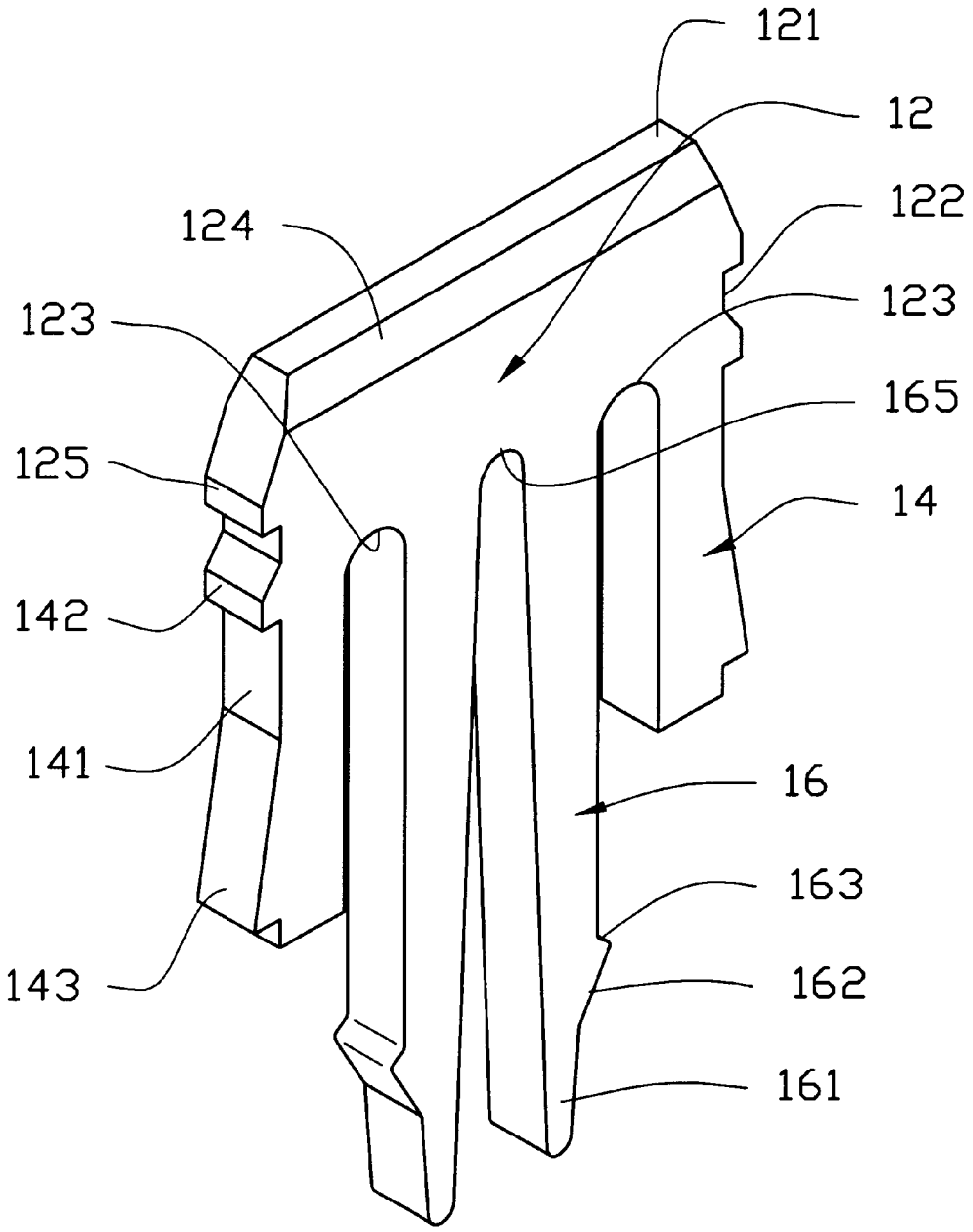
FIG. 1 is a perspective view of a board locking means of an electrical connector in accordance with the present invention.
Figure 2:
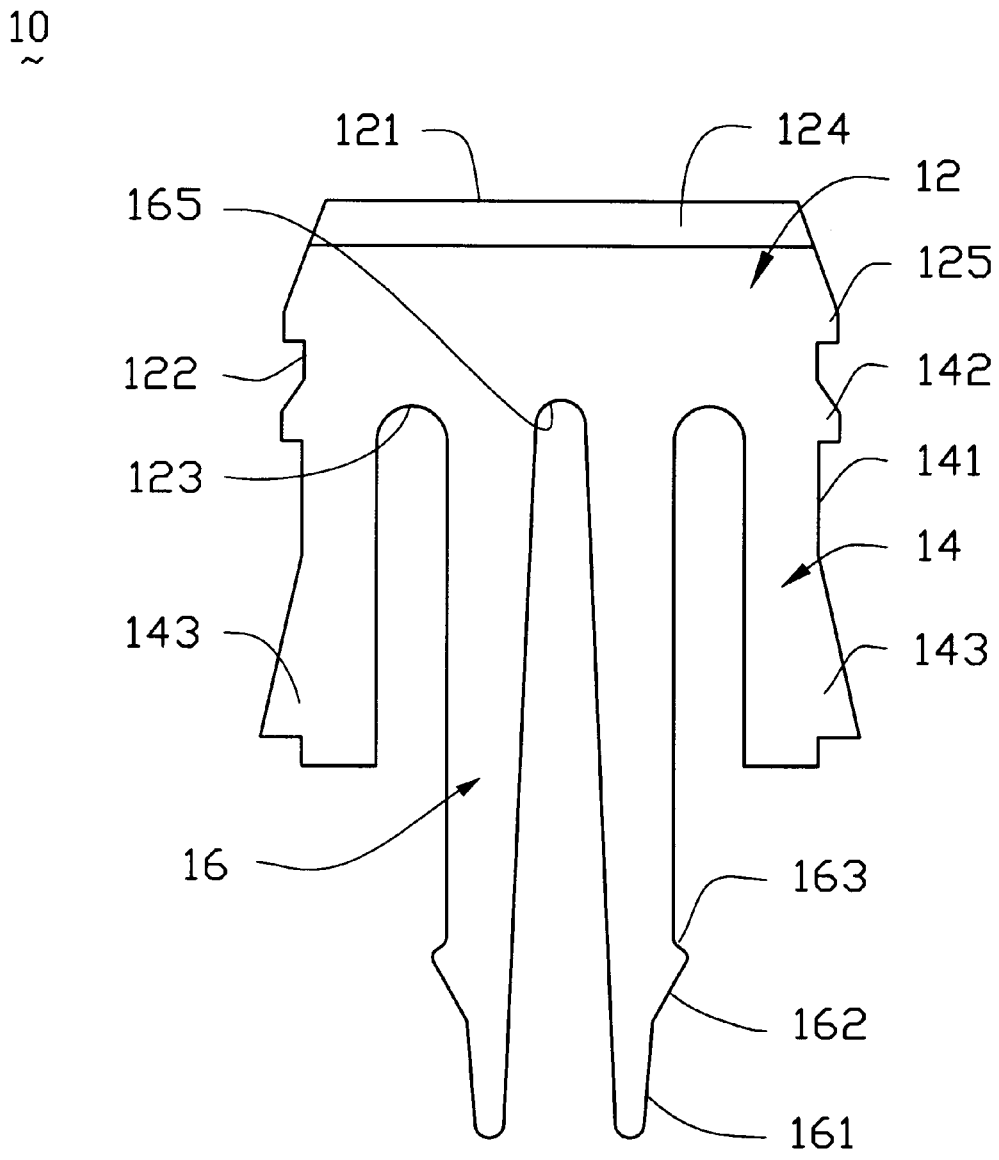
FIG. 2 is a front view of a board locking means of the electrical connector of FIG. 1.

A board locking means (10) as shown in FIGS. 1–2 for retention in a plurality of through holes (not shown) defined in the circuit board to mount the whole electrical connector (5) onto the circuit board, includes a base (12) formed with a plurality of barb-like first attachment portions (125) respectively arranged on opposite lateral sides (122) thereof. The base (12) further forms opposite chamfered lead-in sections (124) on a top side (121) thereof for guiding the insertion of the board locking means (10) into the receiving portion (21) of the housing (20). A pair of opposite extensive arms (14) respectively extends downward from opposite lateral sides (122) of the base (12) wherein each extensive arm (14) further integrally forms a second attachment portion (143) shaped like a triangular fin on an edge (141) thereof. Each second attachment portion (143) of each extensive arm (14) is aligned with the corresponding first attachment portions (125) on each lateral side (122) of the base (12).

A pair of claw-like retention portions (16) vertically extends downward from a bottom side (not labeled) of the base (12) wherein the pair of retention portions (16) are separated from each other by a first space (165) for providing the retention portions (16) with elasticity when the retention portions (16) are initially inserted into a corresponding through hole (not shown) defined in the circuit board. Each retention portion (16) includes an inclined acting section (162) and an engaging section (163) at a free end (161) thereof. The inclined acting section (162) is capable of suffering a reactive force from a border (not shown) of the through hole on the top surface (not shown)

of the circuit board to elastically compress the pair of retention portions (16) to smoothly penetrate the through hole when the acting section (162) initially contacts with the border. The engaging section (163) is capable of latchingly engaging the border of the through hole on a bottom surface (not shown) of the circuit board after the retention portions (16) are completely inserted through the through hole of the circuit board. In addition, each extensive arm (14) is further separated from the retention portions (16) by a second space (123).

In assembly as shown in FIGS. 3–5, the base (12) of the board locking means (10) is upwardly inserted into the first cavity (212) of the receiving portion (21) from the bottom wall (211) of the housing (20) until the base (12) abuts against a bottom wall (not labeled) in the second cavity (213) and the retention portions (16) are exposed beyond the receiving portion (21) of the housing (20). Meanwhile, the first attachment portions (125) of the base (12) are respectively embedded in opposite lateral walls (not labeled) in the second cavity (213) for retaining the base (12) of the board locking means (10) in the housing (20) in a basic status as shown in FIG. 5. Then, the second attachment portions (143) of the extensive arms (14) respectively engage opposite lateral walls (not labeled) in the first cavity (212) to accurately orient the board locking means (10) in the insulative housing (20), and to enhance retention effect between the insulative housing (20) and the board locking means (10). By means of the second space (123) between the retention portions (16) and each extensive arm (14), the retention portions (16) are isolated from each extensive arm (14) to sufficiently reduce the mutual effect in the spatial relationship between the retention portions (16) and the retention arms (14) whereby the retention portion (16) can maintain a higher elasticity thereof which is not affected by the retention of the extensive arms (14) with regard to the housing (20). Oppositely, neither the retention nor the orientation of the extensive arms (14) in the housing (20) is directly involved in the retention portions (16) when the retention portions (16) are subject to an external active force.

While the present invention has been described with reference to a specific embodiment, the description is illustrative of the invention and is not to be construed as limiting the invention in any way. Various modifications to the present invention can be made to the preferred embodiment by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for use with a circuit board, comprising:

an insulative housing having a bottom wall facing the circuit board and defining a receiving portion therein which consists of a first cavity and a second cavity having a width less than that of first cavity;

a board locking means received within the receiving portion of the housing, including a base which is received within said second cavity and integrally formed with at least a cantilevered flexible retention portion extending downward beyond the receiving portion for latching with a corresponding through hole defined in the circuit board, at least a cantilevered flexible extensive arm extending downward from said base and having an attachment portion thereon for orienting and retaining the board locking means in the receiving portion of the housing in an enhancement status wherein a space separates the cantilevered flexible extensive arm from the cantilevered flexible retention portion.

2. The electrical connector as described in claim 1, wherein the base further forms a plurality of attachment portions on opposite lateral sides thereof for latchingly engaging opposite lateral walls in the second cavity.

3. The electrical connector as described in claim 1, wherein the cantilevered flexible retention portion further forms an engaging section and an inclined acting section.

4. An electrical connector for use with a circuit board, comprising:

an insulative housing having a bottom wall facing the circuit board and defining a receiving portion thereon,;

a board locking means received within the receiving portion of the housing, including a base which is integrally formed with a pair of cantilevered flexible retention portions extending downward beyond the receiving portion and separated from each other by a first space for elastically latching with a corresponding through hole defined in the circuit board, and with at least a cantilevered flexible extensive arm extending downward from said base wherein a second space separates the cantilevered flexible extensive arm from the cantilevered flexible retention portions;

a plurality of attachment portions arranged from a corresponding lateral side of the base to a corresponding edge of the cantilevered flexible extensive arm for orienting and retaining the board locking means in the receiving portion of the housing in an enhancement status.

5. The electrical connector as described in claim 4, wherein the attachment portions each consist of at least a barb formed on the lateral side of the base, and a triangular fin formed on the edge of the cantilevered flexible extensive arm.

6. The electrical connector as described in claim 4, wherein the attachment portions are arranged in alignment with each other.

7. A method for assembling a board locking means into a receiving portion of a housing of the connector, the steps comprising:

providing said receiving portion with a first lower cavity and a second upper cavity wherein said second upper cavity is smaller than said first lower cavity;

providing said board locking means with a base from which at least a cantilevered flexible retention portion extends downward beyond a receiving portion of the housing, a first attachment portion formed on the base, and a second attachment portion formed on a cantilevered flexible extensive arm extending downward from the base beside and spaced from the cantilevered flexible retention portion;

inserting the board locking means into said receiving portion wherein said first attachment portion attachment portion first engages within the second upper cavity of the housing for providing an initial retention thereof, thus said board locking means being in a basic status, and said second attachment portion successively engages within the first lower cavity of the housing for providing an additional retention, thus said board locking means being in an enhancement status.

8. An electrical connector for use with a circuit board, comprising:

an insulative housing having a bottom wall facing the circuit board and defining a receiving portion therein which consists of a first cavity and a second cavity having a width less than that of first cavity;

a board locking means received within the receiving portion of the housing, including a base which is received within said second cavity and integrally formed with at least a cantilevered flexible retention portion extending downward beyond the receiving portion for latching with a corresponding through hole defined in the circuit board, and cantilevered flexible extensive arms extending downward from said base and each having an attachment portion thereon to latchingly engage with a respective lateral wall in the first cavity for orienting and retaining the board locking means in the receiving portion of the housing in an enhancement status wherein a space separates the cantilevered flexible extensive arm from the cantilevered flexible retention portion.

* * * * *